United States Patent [19]

Wagenknecht et al.

[11] 4,071,429

[45] Jan. 31, 1978

[54] ELECTROLYTIC FLOW-CELL APPARATUS AND PROCESS FOR EFFECTING SEQUENTIAL ELECTROCHEMICAL REACTION

[75] Inventors: John H. Wagenknecht, Kirkwood, Mo.; Dean G. Laurin, Mount Prospect, both of Ill.

[73] Assignee: Monsanto Company, St. Louis, Mo.

[21] Appl. No.: 755,312

[22] Filed: Dec. 29, 1976

[51] Int. Cl.[2] ..... C25B 9/00; C25B 11/00; C25B 13/00

[52] U.S. Cl. ..... 204/231; 204/228; 204/268; 204/255; 204/59 R; 204/72; 204/73 R; 204/74; 204/78

[58] Field of Search ..... 204/228, 231, 254, 255, 204/253, 268

[56] References Cited

U.S. PATENT DOCUMENTS

| | | | |
|---|---|---|---|
| 3,103,473 | 9/1963 | Juda | 204/77 |
| 3,103,474 | 9/1963 | Juda | 204/104 |
| 3,124,520 | 3/1964 | Juda | 204/86 |
| 3,141,837 | 7/1964 | Edelman | 204/231 X |
| 3,341,445 | 9/1967 | Gerhard | 204/228 |
| 3,573,175 | 3/1971 | Bedi | 204/15 |
| 3,696,017 | 10/1972 | Wallen | 204/195 R |
| 3,787,308 | 1/1974 | Malaspina et al. | 204/195 P |
| 3,884,776 | 5/1975 | Keidel | 204/73 R |
| 4,019,968 | 4/1977 | Spaziante et al. | 204/23 |

*Primary Examiner*—F.C. Edmundson

*Attorney, Agent, or Firm*—Wendell W. Brooks; James W. Williams, Jr.; Joseph D. Kennedy

[57] ABSTRACT

This invention relates to an electrolytic flow-cell apparatus and a process for effecting sequential electrochemical reactions of redoxidative compounds at a porous working electrode. The porous working electrode has a first face and a second and opposite face, at which faces the sequential reactions are effected.

16 Claims, 1 Drawing Figure

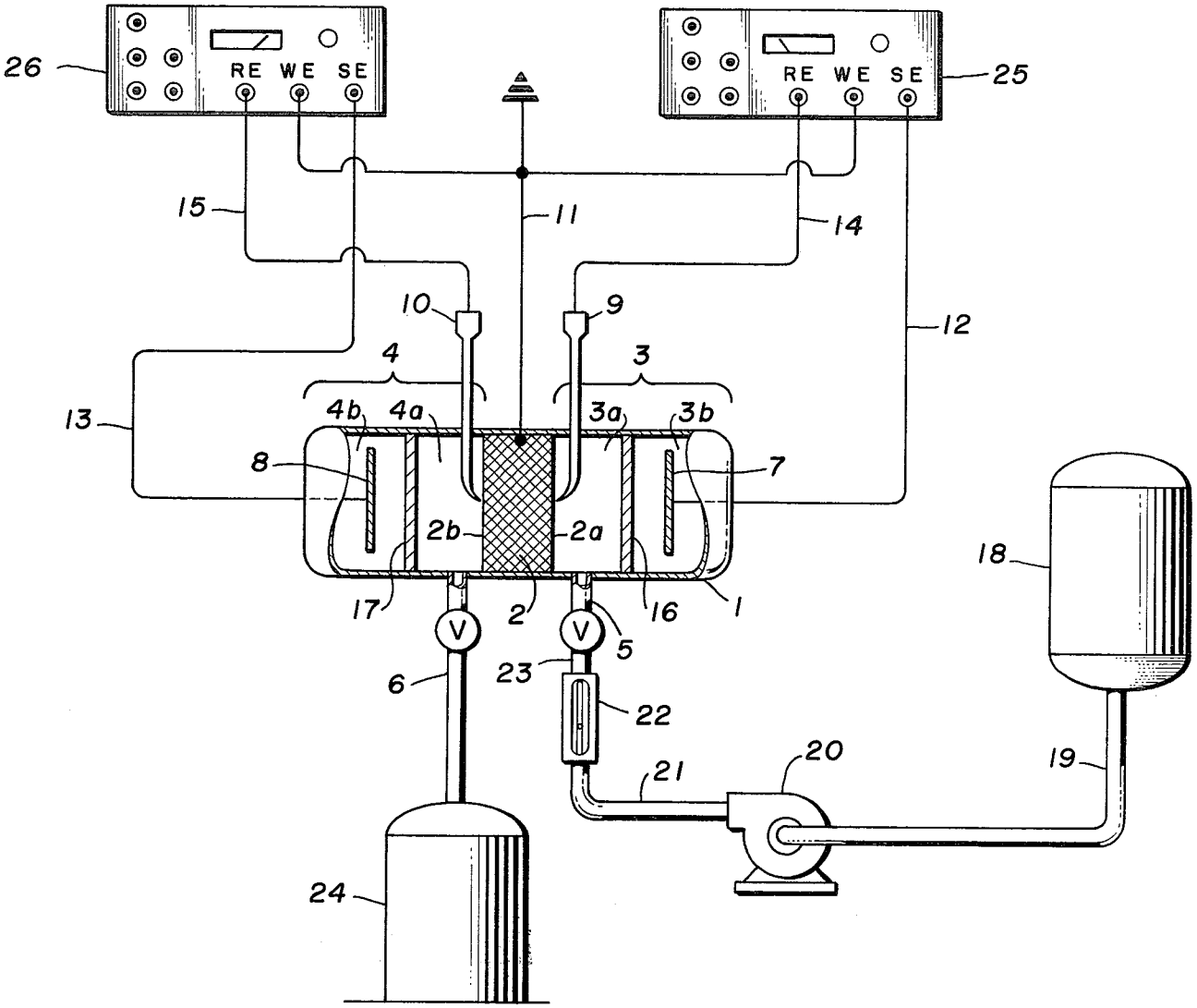
RE WE SE
RE WE SE
1
2
2a
2b
3
3a
3b
4
4a
4b
5
6
7
8
9
10
11
12
13
14
15
16
17
18
19
20
21
22
23
24
25
26

ELECTROLYTIC FLOW-CELL APPARATUS AND PROCESS FOR EFFECTING SEQUENTIAL ELECTROCHEMICAL REACTION

BACKGROUND OF THE INVENTION

This invention relates to an electrolytic flow-cell apparatus and a process for effecting sequential electrochemical reactions of redoxidative compounds at a porous working electrode. The porous working electrode has a first face and a second and opposite face, at which faces the sequential reactions are effected.

Porous electrode elements and flow cells have found wide use in electrochemical conversion reactions. However, it generally has not been possible to convert "short-lived" electrochemically generated species or chemical reaction products thereof to other desired species or products in existing electrolysis apparatus. One reason for this difficulty stems from the fact that previously it has been necessary to employ two separate electrolytic cells, one for the initial electrochemical reaction and the other for the subsequent electrochemical reaction. Following the initial electrolysis, the electrolysis medium containing the initially generated species had to be transferred from the initial electrolytic cell to the subsequent electrolytic cell for the subsequent electrolysis. In effecting this transfer of the electrolysis medium from the initial electrolytic cell to the subsequent electrolytic cell, it has been necessary to maintain a break in the electrolysis medium between the cells in order to prevent interaction between the separate power sources required for each cell.

The procedural requirements associated with the employment of two separate electrolytic cells were very time consuming and inconvenient. And, in those cases where the initially generated species was sufficiently short-lived, the desired conversion could not be effected at all.

It is therefore an object of the present invention to provide an electrolytic flow-cell apparatus and a process for effecting sequential electrochemical reactions of redoxidative compounds.

Various other objects and advantages of the invention will become apparent from the accompanying description and disclosure.

The above and other objects have been accomplished in a very effective and efficient manner by the present invention. The surprising and unexpected success with which the objects have been accomplished is apparent from the unique properties and advantages of the present invention as described in the following specification and claims. Briefly, however, these include effecting the desired sequential electrochemical reactions of redoxidative compounds at the faces of a porous working electrode having a first face and a second and opposite face, with each face being independently maintained at a selectible electrical potential. This independent maintenance of each face of the porous working electrode at a selectible electrical potential permits the present invention to effectively overcome the problems encountered in the prior art occasioned by the employment of two separate electrolytic cells.

Thus, the present invention effects the sequential electrochemical reaction of many redoxidative compounds to yield products previously not conveniently accessible by either electrochemical or chemical means.

BRIEF DESCRIPTION OF THE DRAWINGS

FIG. 1 is a schematic representation of an electrolytic flow-cell apparatus suitable for effecting sequential electrochemical reactions of redoxidative compounds in accordance with principles of the present invention.

SUMMARY OF THE INVENTION

The present invention relates to an electrolytic flow-cell apparatus suitable for effecting sequential electrochemical reactions of redoxidative compounds at a porous electrode having a first face and a second and opposite face.

The present invention also relates to a process for effecting sequential electrochemical reactions of redoxidative compounds at the faces of a porous working electrode having a first face and a second and opposite face. Each of the first face and second and opposite face is independently maintained at a selectible electrical potential.

DETAILED DESCRIPTION OF THE INVENTION

The electrolytic flow-cell apparatus of the present invention will be explained by reference to the accompanying drawing.

Referring to FIG. 1, a schematic representation of the electrolytic flow-cell apparatus of the present invention is shown which comprises a container 1 for holding a liquid electrolysis medium. Container 1 is divided into a first compartment 3 and a second compartment 4 by a porous working electrode 2 having a first face *2a* in first compartment 3 and a second and opposite face *2b* in second compartment 4. For simplicity, working electrode 2 is preferably arranged so that Container 1 is equally divided; that is, first compartment 3 and second compartment 4 are of equal dimensions. However, such an arrangement is not necessary, and other suitable arrangements may be employed as desired.

As shown, inlet means 5 and outlet means 6, both of which are capable of being opened and closed as desired, are provided, respectively, in first compartment 3 for admission of the electrolysis medium and second compartment 4 for withdrawal of the electrolysis medium subsequent to it being subjected to sequential electrolyses. For convenience, a product receiver 24 can be connected to outlet means 6 to receive the sequentially electrolyzed electrolysis medium.

Connected to inlet means 5 are means for effecting flow of the electrolysis medium into compartment 3, through working electrode 2, where it is sequentially electrolyzed (initially at first face *2a* and finally at second and opposite face *2b*), and thereafter into second compartment 4, from which it is withdrawn via outlet means 6.

The flow means of the electrolytic flow-cell apparatus of the present invention comprise in combination a reservoir 18 for containing the electrolysis medium, a pump 20 for pumping the electrolysis medium, a flow meter 22 for controlling the flow rate of the electrolysis medium, and means for connecting same, in the sequence set forth to inlet means 5. That is, the flow means comprise reservoir 18, pump 20 connected to reservoir 18 via flow line 19, and flow meter 22 connected to both pump 20 via flow line 21 and inlet means 5 via flow line 23. This arrangement advantageously permits continuous operation of the electrolytic flow-cell apparatus in a very efficient manner.

Located within each of first compartment 3 and second compartment 4 and spaced, respectively, from first face 2*a* and second and opposite face 2*b* is a secondary electrode 7 and 8.

A first means for establishing and maintaining a selectible electrical potential at first face 2*a* of working electrode 2 is provided. Working electrode 2 is connected via electrical lead 11 to the working electrode terminal of first controllable source 25 of direct electrical current, and first secondary electrode 7 is connected via electrical lead 12 to the secondary electrode terminal of first controllable source 25.

In a similar manner, a second means for establishing and maintaining a selectible electrical potential at second and opposite face 2*b* of working electrode 2 is provided. Working electrode 2 is connected via electrical lead 11 to the working electrode terminal of a second controllable source 26 of direct electrical current, and second secondary electrode 8 is connected via electrical lead 13 to the secondary electrode terminal of second controllable source 26.

If it is desired to determine the potential at first face 2*a* and second face 2*b* of working electrode 2 while an electric current flows across the first face 2*a*-electrolysis medium interface and the second and opposite face 2*b*-electrolysis medium interface at working electrode 2, it is necessary to introduce a third electrode, a reference electrode, the potential of which is known and stable and which is not polarized by the current. Reference electrodes 9 and 10 can be positioned, respectively, in the space between first face 2*a* and first secondary electrode 7, and second face 2*b* and second secondary electrode 8. Preferably, reference electrodes 9 and 10 are positioned substantially adjacent to the two faces (2*a* and 2*b*) of working electrode 2. That is, they are positioned so as to minimize the distance between their tips and the respective faces of working electrode 2.

When reference electrodes 9 and 10 are employed, the selectible electrical potential is established and maintained as a function of a reference potential. This is accomplished by connecting reference electrode 9 via electrical lead 14 to the reference electrode terminal of first controllable source 25 and connecting reference electrode 10 via electrical lead 15 to the reference electrode terminal of second controllable source 26.

The term "working electrode" is employed herein in its generally recognized meaning of an electrode at which the electrochemical reaction of interest occurs. When reductions are being studied, the cathode is the working electrode; in oxidations, the anode is the working electrode.

The "secondary electrode", also known as the "auxiliary electrode" or "counter electrode", is a current-carrying electrode other than the working electrode, whose presence is necessary to complete the electrical circuit but at which the reactions occurring are of secondary interest: the anode is the secondary electrode when reductions are being studied, and the cathode is the secondary electrode in oxidative studies.

The term "reference electrode" is employed herein to mean an electrode, usually an electrochemical half-cell, of relatively stable and known potential.

The dimensions, structural details and operation parameters of the electrolytic flow-cell apparatus of the present invention can vary within fairly wide limits. Container 1 can be constructed from a wide variety of material so long as the material is capable of resisting action of electrolytes. That is, the construction material must be inert under reaction conditions. Suitable material, which is also widely available, include, for example, steel, iron, nickel, carbon, glass, various plastics such as, for example, polytetrafluoroethylene (Teflon) and the like.

Working electrode 2 may be of any porous electrode material known in the art so long as it is relatively inert under the reaction conditions. Suitable porous material includes, for example, carbon, lead-lead(IV) oxide (from lead wool), platinum screen, nickel, steel, copper, and the like. It will be recognized, however, that the choice of a particular working electrode material will vary with the specific reaction being conducted.

Working electrode 2 may also be of any desired and convenient thickness, with due consideration to having it thick enough to permit independent establishment and maintenance of each of its two faces (2*a* and 2*b*) at a selectible electrical potential. That is, working electrode 2 must be thick enough to prevent any significant and adverse interaction between first controllable source 25 and second controllable source 26 of direct electrical current. Conversely, working electrode 2 must be thin enough to permit the initial electrolytically generated species, that is, the species initially generated at first face 2*a*, to reach second and opposite face 2*b* prior to its undergoing decomposition or some other undesirable chemical side-reaction. It is thus apparent that if the initially generated species is very short-lived, thinner working electrodes 2 are desirable in order to decrease the time lag between the initial electrolytic reaction at first face 2*a* and the final electrolytic reaction at second and opposite face 2*b*. It will of course be apparent to those skilled in the art that the relative rate with which the electrolysis medium passes through working electrode 2 will, in addition to its relative thickness, depend to some extent upon its porosity as well as the flow rate of the electrolysis medium. A suitable and convenient thickness for working electrode 2 is about 1.0 centimeter.

The secondary electrodes 7 and 8 can be of any electrode material so long as they are resistant to the action of the electrolysis medium under the reaction conditions. Ordinarily, the secondary electrodes 7 and 8 will have little, if any, influence on the course of the reaction and can be selected so as to minimize expense and any corrosion or erosion problems. Thus, for example, materials such as platinum, carbon, steel, nickel, lead (as a cathode in oxidations), lead (IV) oxide (as an anode in reduction), and the like are suitable.

The inclusion and employment of reference electrodes 9 and 10 permit the use of the preferred controlled-potential (potentiostatic) technique instead of the generally more simple controlled current technique.

In general, the controlled-potential technique involves automatic control of the working-electrode potential at a constant value relative to a reference electrode throughout the electrolysis. This control is achieved by an instrument known as a potentiostat, which measures the voltage established between the working electrode and the reference electrode and compares this with a desired value set on a potentiometer. Thus potentiostatic control requires three electrodes—a working electrode, a secondary electrode, and a reference electrode.

In contrast to the controlled-potential technique, the controlled-current technique requires only two electrodes—a working electrode and a secondary electrode—across which a direct electric current is passed.

This technique, however, is best employed when the reaction involved is fully characterized rather than in those stages of a study in which the reaction pathway is uncertain. That is, once the preferred conditions for effecting reaction of a patricular compound have been determined by the controlled-potential technique, the controlled current technique may be used, if desired. The quantity of electricity consumed in the reaction is easily determined by using a constant-current source such as, for example, an amperostat and timing the period of the particular electrolysis.

Of these two techniques, the controlled potential technique is preferred in the present invention. Since electrolytic reactions are electrode potential dependent, considerable advantages result from suitable control thereof. For example, through its proper use, (a) undesired side-reactions resulting in production of undesired by-products, where more than one product is possible can be minimized or eliminated entirely; (b) specific functional groups can be electrolyzed in the presence of other electro-active groups; and (c) compounds capable of undergoing multistep electrolyses can be controlled to produce an intermediate product.

Thus the preferred controllable sources of direct electrical current are potentiostats. That is, first controllable source 25 of direct electrical current and second controllable source 26 of direct electrical current are preferably potentiostats.

It will be apparent to those skilled in the art that when the controlled-potential technique is employed the actual potential under control is that which exists between the tips of reference electrodes 7 and 8 and the respective surfaces, that is, first face 2*a* and second and opposite face 2*b* of working electrode 2. It is preferred that the working electrode 2 is set at ground potential so that first face 2*a* and second and opposite face 2*b* are either negative or positive as desired relative to the electrolysis medium immediately adjacent thereto. For example, when sequential oxidations are being effected, first face 2*a* and second and opposite face 2*b* are both more positive relative to the electrolysis medium immediately adjacent thereto; when sequential reductions are being effected, first face 2*a* and second and opposite face 2*b* are more negative. Of course, when different sequential electrochemical reactions are being effected at first face 2*a* and second and opposite face 2*b*, the electrode potential at each face will be opposite that at the other face. That is, the electrode potential at first face 2*a* will be of one sign (positive or negative) and that at second and opposite face 2*b* will be of the opposite sign (negative or positive).

In general, the electrode potential at first face 2*a* and second and opposite face 2*b* of working electrode 2 can be maintained at a selected value or it can be varied. It will be apparent, however, that in order to minimize any possible adverse alteration in the course of the sequential electrochemical reaction or product distribution, the electrode potentials at first face 2*a* and second and opposite face 2*b* of working electrode 2 are preferably no greater than that which is necessary to effect the desired sequential electrochemical conversion of the redoxidative compound to the desired product. That is, the electrode potential at first face 2*a* will be sufficient to convert the redoxidative compound into an initial electrochemically generated species but insufficient to cause substantial adverse side reactions. Similarly, the electrode potential at second and opposite face 2*b* will be sufficient to convert the initial electrochemically generated species or the desired product but insufficient to cause substantial production of undesired by-products. Suitable first face 2*a* electrode potentials will often be no more than about +2.0 volts (versus a saturated calomel electrode) for oxidations and about −1.0 volt (versus a saturated calomel electrode) for reductions; second and opposite face 2*b* electrode potentials will have values of similar magnitude. It will of course be recognized that the value at both first face 2*a* and second and opposite face 2*b* will vary with working electrode 2 materials and their surface conditions, and various materials in the electrolysis medium.

Various current densities can be employed in the present invention. It will be desirable to employ high current densities in order to achieve high use of the electrolytic flow-cell apparatus capacity, and therefore for production purposes it will generally be desirable to use as high a density as feasible, taking into consideration sources and cost of electrical current, resistance of the electrolysis medium, heat dissipation, effect upon yields, and the like. Over broad ranges of current density, the density will not greatly affect the yield. Suitable ranges for efficient operation will generally be in the ranges from a few milliamperes per square centimeter of working electrode 2 surface (first face 2*a* and second and opposite face 2*b*), up to 10 or 100 or more milliamperes per square centimeter.

First compartment 3 and second compartment 4 can, if desired, be partitioned, respectively, into first working electrode compartment 3*a* and first secondary electrode compartment 3*b*, and second working electrode compartment 4*a* and second secondary electrode compartment 4*b* by porous or semi-permeable dividers 16 and 17 positioned, respectively, between first face 2*a* of working electrode 2 and first secondary electrode 7, and second and opposite face 2*b* of working electrode 2 and second secondary electrode 8. Such dividers are relatively inert to the electrolysis medium under reaction conditions, and, when employed, prevent the free flow of reactants between first face 2*a* of working electrode 2 and first secondary electrode, and second an opposite face 2*b* of working electrode 2 and second secondary electrode 8.

The prevention of the free flow of reactants between first face 2*a* and second and opposite face 2*b* and the respective secondary electrodes (7 and 8) becomes highly advantageous and preferred when the electrochemically generated species from either (or both) face(s) of working electrode 2 undergo reverse or other undesirable side reactions at the corresponding secondary electrode.

Materials suitable for use in the electrolytic flow-cell apparatus of the present invention as dividers include, for example, fritted glass filters, glass cloth, asbestos, porous poly(vinyl chloride), and the like. Ion exchange membranes can also be employed.

Also, while not shown, first compartment 3 and second compartment 4, or, when dividers 16 and 17 are used, first working electrode compartment 3*a*, first secondary electrode compartment 3*b*, second working electrode compartment 4*a*, and second secondary compartment 4*b* can be equipped with pressure or gas vents capable of being opened and closed as desired. The inclusion of such pressure vents is especially advantageous and convenient for those reactants wherein gases are produced or wherein it is desirable to conduct the reactions under an inert atmosphere such as, for example, nitrogen, helium, and the like.

When dividers 16 and 17 are used to partition first compartment 3 and second compartment 4, respectively, it is possible to employ the same electrolysis medium on both the working electrode sides (first working electrode compartment 3*a* and second working electrode compartment 4*a*) and the respective secondary electrode sides (first secondary electrode compartment 3*b* and second secondary electrode compartment 4*b*), or to employ different media. In some circumstances, it may be advisable to employ a different medium on the secondary electrode sides, first secondary electrode compartment 3*b* and second secondary electrode compartment 4*b*, for economy of materials, lower electrical resistance, and the like.

The electrolytic flow-cell apparatus of the present invention is suitable for conducting electrochemical sequential reactions over a broad range of temperatures and pressures. For purposes of adjusting and maintaining the temperature as desired, container 1 can be equipped with any number of thermostating devices known to the art. For example, container 1 can be placed in a thermostated bath, jacketed to take circulated theremostated liquid, wrapped in heating cord or tape, or the like. In general, the methods described in Tomilov et al, *Electrochemistry of Organic Compounds,* John Wiley & Sons, Inc. (Halsted Press Division), New York, 1972, pp. 95–109 may be employed.

Pressures substantially above and below atmospheric pressure can be employed in the electrolytic flow-cell apparatus of the present invention, if desired. Elevated pressures may be especially suitable for conducting reactions at higher temperatures with volatile reactants, but for reasons of economy and ease of construction of the electrolytic flow-cell apparatus of the present invention, it is preferred to employ approximately atmospheric pressure.

Either batch or continuous operations can be conducted in the electrolytic flow-cell apparatus of the present invention. Under continuous operating conditions, the product can be continuously removed via outlet means 6 and collected in product receiver 24. From product receiver 24, or, alternatively, directly from outlet means 6, the electrolysis medium can be recycled, and additional reactants can be added continuously or intermittently, and electrolyte salt or other electrolysis medium components can be augmented, replenished, or removed as appropriate.

It will be noted, however, that when the sequential electrochemical reactions involve an initial reduction followed by a subsequent oxidation or an initial oxidation followed by a subsequent reduction, it may be advantageous to isolate the product prior to recycling the electrolysis medium. This may be attributed to the fact that the product may undergo reverse reaction, and thereby defeat the purpose of recycling the electrolysis medium in order to increase the overall yield of product.

Continuous operating conditions are especially advantageous when the controlled-current technique is employed in that the reactant can be maintained at a concentration sufficient to maintain the desired current flow at all times without an undesirable increase in the potential at first face 2*a* and second and opposite face 2*b* of working electrode 2.

With continued reference to FIG. 1, the process of effecting sequential electrochemical reactions will be described. For convenience, the operation procedure as employed herein will be described with reference to the procedure wherein dividers 16 and 17 are employed to partition first compartment 3 and second compartment 4, respectively, into first working electrode compartment 3*a* and first secondary electrode compartment 3*b* and second working electrode compartment 4*a* and second secondary electrode compartment 4*b*. It will be understood by those skilled in the art, however, that essentially the same procedure can be employed in the absence of dividers 16 and 17 when redoxidative compounds compatible with sequential electrochemical reactions in an undivided-type cell are employed. That is, when redoxidative compounds which will not undergo reversal or other undesired side-reaction at either or both secondary electrodes are employed, the present process may be conducted in the absence of dividers 16 and 17.

The expression "redoxidative compound" as employed herein means a compound capable of being converted initially at first face 2*a* of working electrode 2 into an initial electrochemically generated species and subsequently at second and opposite face 2*b* of working electrode 2 into a subsequent electrochemically generated species of final product. The conversions can comprise either of four possible combinations: (a) initial oxidation-subsequent reduction; (b) initial reduction-subsequent oxidation; (c) initial oxidation-subsequent oxidation; or (d) initial reduction-subsequent reduction.

Exemplary of the initial and subsequent electrochemically generated species are cations or carbonium ions, free radicals, or anions in independent sequences. Thus, employing conversion combination (a), an example of such a reaction sequence is that the redoxidative compound can be initially oxidized at first face 2*a* to a cation or a carbonium ion and subsequently reduced at second and opposite face 2*b* to a free radical, which can undergo coupling to produce the final product.

In the preferred process of operating the electrolytic flow-cell apparatus of the present invention, the electrolysis medium (containing the redoxidative compound) is charged to reservoir 18 from which it flows via flow line 19 through pump 20, into flow line 21, through flow meter 22, and thereafter via flow line 23 and inlet means 5 into first working electrode compartment 3*a* where it passes through working electrode 2 in a single-pass process. The electrical potential at first face 2*a* of working electrode 2 is sufficient to cause conversion, whether oxidation or reduction, to an initial electrochemically generated species. Similarly, the electrical potential at second and opposite face 2*b* is sufficient to convert the initial electrochemically generated species to a subsequent electrochemically generated species to a subsequent electrochemically generated species or final product. Thus, as the electrolysis medium passes through first face 2*a* of working electrode 2, the redoxidative compound is converted into an initial electrochemically generated species. The resulting medium, now containing the initial electrochemically generated species, passes through working electrode 2 where the species is electrolyzed at second and opposite face 2*b* to convert it into a subsequent electrochemically generated species or final product. Finally, the sequentially electrolyzed electrolysis medium flows into second working electrode compartment 4*a* from which it is removed via outlet means 6 and collected in product receiver 24.

Suitable working electrode potentials at the first and second faces (2*a* and 2*b*) of working electrode 2, as noted hereinabove, are generally no more than about +2.0 volts for oxidations and −1.0 volt for reductions.

The process of the present invention can be conveniently illustrated by the preparation of nitrosobenzene from nitrobenzene.

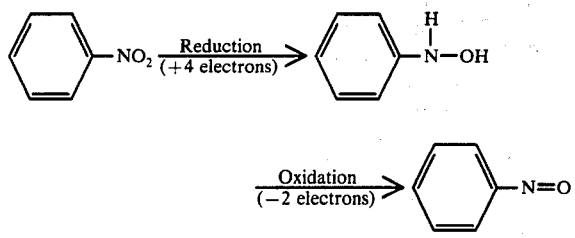

Nitrosobenzene is too easily reduced to be isolated by direct reduction of nitrobenzene. Thus the reduction continues to the N-phenylhydroxylamine, which is thereafter oxidized to the desired nitrosobenzene.

While electrochemical preparation of nitrosobenzene from nitrobenzene in electrolytic cells of the prior art can be accomplished, the method suffers from the inconvenience of having to transfer the N-phenylhydroxylamine to a separate electrolytic cell for the oxidation step.

The chemical preparation of nitrosobenzene from nitrobenzene proceeds in a similar manner. However, three time-consuming steps involving (a) reduction of nitrobenzene in neutral solution; (b) isolation of the resulting N-phenylhydroxylamine; and (c) oxidation of the N-phenylhydroxylamine in acid solution, usually chromic acid, are required.

In marked contrast to the above two methods, the present process provides the nitrosobenzene in one smooth operation.

Other examples of sequential electrochemical reactions include the preparation of hydroquinone from phenol and the preparation of 4-aminodiphenylamine (p-semidine) from aniline. In the former reaction, phenol is oxidized to p-benzoquinone, which is reduced to hydroquinone,

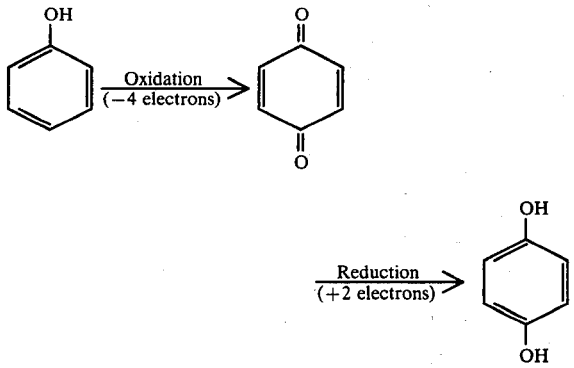

while in the latter reaction, aniline is oxidized to N-phenylquinonediimine, which is reduced to 4-aminodiphenylamine.

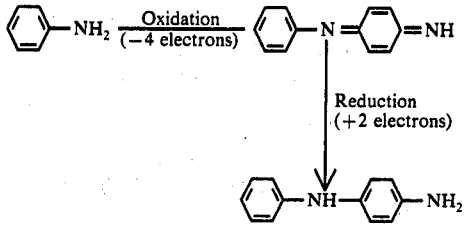

The operation of the electrolytic flow-cell apparatus of the present invention requires the presence of a liquid electrolysis medium that will conduct electrical current. Therefore, a supporting electrolyte is employed with the solvent in order to enhance conductivity of the electrolysis medium. A supporting electrolyte, as understood by those skilled in the art, is an electrolyte capable of carrying electrical current but not discharging under the electrolysis conditions. For example, dilute aqueous solutions of strong mineral acids having concentrations of from about 0.5 percent to about 5 or 10 percent by weight based on the weight of acid and water, and seldom more than 20 percent by weight on the same basis, or on a molar basis, from about 0.05 molar to about 2 molar are suitable. In general, however, the concentration will often be about 10 percent or 1.0 molar. Sulfuric acid is especially suitable for use in the present invention in that, when employed in such concentrations, it is practical and useful from the viewpoint of conductivity and low-electrode corrosion. Other strong acids, for example, those having relatively high ionization constants, for example, greater than $10^{-3}$ at 25 ° C and exerting no other adverse effects can also be suitably employed.

When electrolysis media other than aqueous mineral acid solutions are desired, a supportng electrolyte salt can be utilized. The term "salt" is employed in its generally recognized sense to indicate a compound of a cation and a anion, such as produced by reaction of an acid with a base. The electrolyte salts can be organic, inorganic, or mixtures of such, and composed of simple cations and anions or very large complex cations and anions.

Certain salts of alkali and alkaline earth metals as well as amine and quaternary ammonium salts can be employed as supporting electrolytes. Among the alkali and alkaline earth metal salts useful are the lithium, sodium, potassium, rubidium, magnesium, calcium, and the like; among the quaternary ammonium salts useful are the tetraalkylammonium, for example, tetramethylammonium, tetraethylammonium, tetra-n-propylammonium, and the like, heterocyclic and araalkylammonium salts, for example, benzyltrimethylammonium, and the like.

The term "quaternary ammonium" as employed herein has its usual recognized meaning of a cation having four organic groups substituted on the nitrogen.

Various anions can be used with the foregoing and other cations such as, for example, acetates, perchlorates, tetrafluoroborates, hexafluorophosphates, phosphates, sulfates, sulfonates, tetraphenylborides, and the like. Aromatic sulfonates and similar anions, including those referred to as McKee salts, can be used, as can other hydrotropic salts, although the hydrotropic property may be of no particular significance when employed with solvents having very low water content.

The concentration of electrolyte salts, when used, can vary widely, for example, from about 0.5 percent to about 50 percent or more by weight of the electrolysis medium, but suitable concentrations will often be in the range of about 1.0 percent to about 15 percent by weight, or on a molar basis, often in the range of about 0.1 to about 1.0 molar. If, however, it is desired to have all the components in solution, the amount of electrolyte salt utilized will be no greater than will dissolve in the electrolysis medium.

Solvents suitable for use in the present process (a) should be relatively inert under process conditions and (b) should have a fairly high dielectric constant in order to lower the electrical resistance.

The term "relatively inert" is employed herein to describe solvents which, under process conditions, (a) do not preferentially undergo electrochemical reaction and (b) do not significantly react with either the starting materials (redoxidative compounds), species generated therefrom, or the desired final products (unless, of course, such reactivity is desired to form specific products as discussed hereinbelow and as illustrated in TABLE 1, reaction (6) hereinbelow).

It is found in practice that it is generally desirable to employ a solvent with a dielectric constant of at least 25 or higher. Examples of such solvents include, for example, water, acetonitrile, propanenitrile, benzonitrile, dimethylformamide, hexamethylphosphoramide, sulfolane, and the like. Many of the useful solvents can be characterized as aprotic but it is not essential that such solvents be employed. In fact, if all or most other factors are equal, water may be the preferred solvent from an economic standpoint.

Additional information concerning non-aqueous solvents, including aprotic as well as protic solvents, can be obtained from Mann, "Nonaqueous Solvents for Electrochemical Use," in *Electroanalytical Chemistry,* Volume 3, (Bard, ed.), Marcel Dekker, New York, 1969, pp. 57–134.

The concentration of the redoxidative compound can vary widely, for example, from about 0.001 percent to about 50 percent or more by weight of the electrolysis medium, or on a molar basis, from about 0.0001 to about 5 molar. In general, however, the concentration will often be in the range between about 0.01 percent and about 15 percent by weight, or on a molar basis, between about 0.001 molar to about 1.5 molar. It will be recognized, however, that the actual concentration employed may vary with the particular redoxidative compound under consideration.

It is also within the scope of the present invention that certain in situ compounds can be added to either the initial electrochemically generated species or the subsequent electrochemically generated species to produce numerous addition products.

An example of the former addition reaction involves the sequential electrochemical reaction of toluene. Oxidation at first face 2*a* of working electrode 2 with the removal of two electrons would yield the benzyl carbonium ion which can add a suitable nucleophilic species such as, for example, acetonitrile to yield the N-benzylacetonitrilium ion. Subsequent reduction of this cation at second and opposite face 2*b* of working electrode 2 with the addition of one electron would yield the corresponding N-benzylacetonitrilium free radical. Coupling of these radicals would yield 2,3-butanedione bis-benzylimine.

An example of the latter addition reaction involves the sequential electrochemical reaction of chloroacetonitrile (chloromethyl cyanide). Reduction at first face 2*a* of working electrode 2 with the addition of two electrons would yield the cyanomethyl carbanion which can undergo reverse oxidation at second and opposite face 2*b* of working electrode 2 with the removal of one electron to yield the cyanomethyl free radical. Subsequent addition of the free radical to a suitable compound such as, for example, 1,3-butadiene followed by coupling of the resulting free radicals would yield 4,8-dodecadienedinitrile.

The exemplary addition reactions described above are illustrated, respectively, by reaction (6) (where R is methyl, $CH_3$) and reaction (2) as shown in TABLE 1, hereinbelow.

The products obtained in the present process during operation of the electrolytic flow-cell apparatus of the present invention can be detected by conventional means such as, for example, polargraphic analysis, gas and paper chromatography, and spectroscopic techniques such as, for example, nuclear magnetic resonance, infrared, and ultraviolet spectroscopy.

The products can also be readily recovered by conventional means. When the electrolysis medium is aqueous, the products can be extracted with a suitable solvent, for example, benzene, hexane, carbon tetrachloride, methylene chloride, diethyl ether, and the like, dried over an appropriate dessicant, for example, anhydrous sodium sulfate, magnesium sulfate, and the like, filtered, and the solvent evaporated in vacuo to yield the crude product. When the final product is a solid, it can be purified by recrystallization from a suitable solvent such as, for example, pentane, hexane, chloroform, acetonitrile, and the like, whereas when the product is a liquid, it can be purified by fractional distillation at appropriate temperature and pressure conditions.

When an organic solvent is used, it can be removed by evaporation in vacuo to yield the crude product. Purification of this product can be readily accomplished as described hereinabove for products recovered from aqueous solution.

The following examples illustrate the present invention and the manner by which it can be practiced.

EXAMPLE 1 — Nitrosobenzene

The electrolysis was conducted in the electrolytic flow-cell apparatus shown in FIG. 1 with the exception that each of the first and second working electrode compartments (3*a* and 4*a*) and the first and second secondary electrode compartments (3*b* and 4*b*) contained a pressure vent capable of being opened and closed as desired. The working electrode was a 2.54 centimeter diameter, 1.0 centimeter thick porous carbon disc (National Carbon Company Grade 45 porous carbon) and the secondary electrodes were platinum foil (3.8 centimeters × 3.8 centimeters). The reservoir was charged with 1500 milliliters of solution made up from 2.0 grams (0.016 mole) of nitrobenzene, 123.0 grams (1.5 moles) of sodium acetate, and 90.0 grams (1.5 moles) of acetic acid dissolved in water. A similar solution (50 milliliters) but without the nitrobenzene was charged to each secondary electrode compartment. The flow rate of the solution from the reservoir, as determined by the flow meter, was 20 milliliters per minute; the first face (2*a*) of working electrode 2 current was 300 milliamperes at −0.6 volt versus the saturated calomel electode; and the second and opposite face (2*b*) of working electrode 2 current was 75 milliamperes at +1.0 volt versus the saturated calomel electrode. The electrolysis was conducted over a period of 1.25 hours. The sequentially electrolyzed electrolysis medium was collected and extracted with hexane. Polarographic analysis of the hexane extract showed the presence of nitrosobenzene. The current yield was 50.4 percent based on the second and opposite face (*2b*) current.

EXAMPLE 2 — Hydroquinone

Procedure A — Employing the apparatus described in EXAMPLE 1 above, a 1.0 liter solution containing 9.4 grams (0.1 mole) of phenol, 15.2 grams (0.107 mole) of sodium sulfate, and 3.0 grams (0.0306 mole) of sulfuric acid in water was charged to the reservoir. A similar solution (50 milliliters) but without the phenol was charged to each secondary electrode compartment. The flow rate of the solution from the reservoir, as determined by the flow meter, was 10 milliliters per minute; the first face (*2a*) current was 500 milliamperes at +1.8 volts versus the saturated calomel electrode; and the second and opposite face (*2b*) current was 90 milliamperes at −0.5 volt versus the saturated calomel electrode. The electrolysis was conducted over a period of 1.66 hours. The resulting sequentially electrolyzed electrolysis medium was collected and extracted with diethyl ether. Polarographic and gas chromatographic analysis showed the presence of the desired hydroquinone.

Procedure B - The apparatus described in EXAMPLE 1 above was employed except that the porous carbon disc working electrode was replaced with a lead (IV) oxide anode (first face (*2a*)-lead cathode (second face *2b*) working electrode.

The lead (IV) oxide anode-lead cathode working electrode was prepared from lead wool which had been compressed into a 2.54 centimeter diameter, 1.0 centimeter thick mat. First face *2a* was made the anode. Aqueous sulfuric acid (1.0 molar) was charged to the reservoir and pumped through the apparatus while an anodic current of 500 milliamperes was passed at first face *2a* until the lead wool had acquired the chracteristic black deposit of lead (IV) oxide, a period of about 1.0 hour. The apparatus was drained of the aqueous sulfuric acid and flushed with water.

The reservoir was charged with 1.0 liter of solution made from 9.4 grams (0.1 mole) of phenol and 1.0 molar aqueous sulfuric acid. A similar solution (50 milliliters) but without the phenol was charged to each secondary electrode compartment. The flow rate of the solution from the reservoir, as determined by the flow meter, was 10 milliliters per minute; the first face (*2a*) of working electrode 2 had a constant current of 100 milliamperes; and the second and opposite face (*2b*) of working electrode 2 current was 50 milliamperes at −0.5 volt. The electrolysis proceeded for a period of 1.66 hours. The resulting sequentially electrolyzed medium was collected and extracted with diethyl ether. Gas chromatographic analysis of the ether extract showed the presence of the desired hydroquinone.

EXAMPLE 3 — 4-Aminodiphenylamine (p-Semidine)

The apparatus described in EXAMPLE 1 above was employed. Two liters of solution containing 20.0 grams (0.215 mole) of aniline, 54.4 grams (0.2 mole) of tetra-n-propylammonium tetra-fluoroborate in acetonitrile was charged to the reservoir. A similar solution (50 milliliters) but without the aniline was charged to each of first and second secondary electrode compartments 3b and 4b. The flow rate of the solution from the reservoir, as determined by the flow meter, was 30 milliliters per minute; the first face *2a* of working electrode 2 current was 180 milliamperes at +1.2 volts versus the saturated calomel electrode (with occasional cathodic pulses to restore electrode activity); and the second and opposite face *2b* of working electrode 2 current was 20 milliamperes at −0.5 volt versus the saturated calomel electrode. The electrolysis was conducted over a period of 1.11 hours. The resulting sequentially electrolyzed electrolysis medium was collected and the solvent evaporated in vacuo to yield a residue which was agitated with hexane to remove unreacted aniline. The small quantity of oil remaining after the extraction by hexane was shown to be 4-aminodiphenylamine via gas chromatographic analysis and comparison with an authentic sample.

The small yield was apparently due to the fact that first face *2a* became coated eventually so that only very small currents could be obtained at the low electrode potentials employed.

In addition to the compounds utilized in the specific examples hereinabove, other representative compounds and their possible mode of reaction at working electrode 2 are shown in TABLE 1.

TABLE 1[a]

$$R_2NCH_3 \xrightarrow[(-2\text{ electrons})]{\text{Oxidation}} R_2\overset{+}{N}{=}CH \xrightarrow[(+1\text{ electron})]{\text{Reduction}} R_2N{-}CH_2\,. \longrightarrow R_2NCH_2CH_2NR_2 \qquad (1)$$

$$NCCH_2Cl \xrightarrow[(+2\text{ electrons})]{\text{Reduction}} NCCH_2 \xrightarrow[(-1\text{ electron})]{\text{Oxidation}} NCCH_2\,. \xrightarrow{CH_2{=}CH{-}CH{=}CH_2} .\,NCCH_2{-}(CH_2CH{=}CHCH_2){-}CH_2CN \qquad (2)$$

$$\begin{array}{l} Br{-}CH{-}CO_2CH_2CH_3 \\ \quad\;\; | \\ Br{-}CH{-}CO_2CH_2CH_3 \end{array} \xrightarrow[(+2\text{ electron})]{\text{Reduction}} \begin{array}{l} \;\;{-}CH{-}CO_2CH_2CH_3 \\ \quad\;\; | \\ Br{-}CH{-}CO_2CH_2CH_3 \end{array} \xrightarrow[(-1\text{ electron})]{\text{Oxidation}} \qquad (3)$$

$$.\begin{array}{l} CH{-}CO_2CH_2CH_3 \\ \;\; | \\ Br{-}CH{-}CO_2CH_2CH_3 \end{array} \longrightarrow \left( \begin{array}{l} \;\;{-}CH{-}CO_2CH_2CH_3 \\ \quad\;\; | \\ Br{-}CH{-}CO_2CH_2CH_3 \end{array} \right)_2$$

$$NC{-}CH{=}CHCO_2CH_3 \xrightarrow[(+2\text{ electron})]{\text{Reduction}} NC{-}CH{-}\overset{CO_2CH_3}{\overset{|}{CH}}{-}\underset{CO_2CH_3}{\underset{|}{CH}}{-}\overline{C}HCN \xrightarrow[(-2\text{ electrons})]{\text{Oxidation}} \qquad (4)$$

TABLE 1[a-continued]

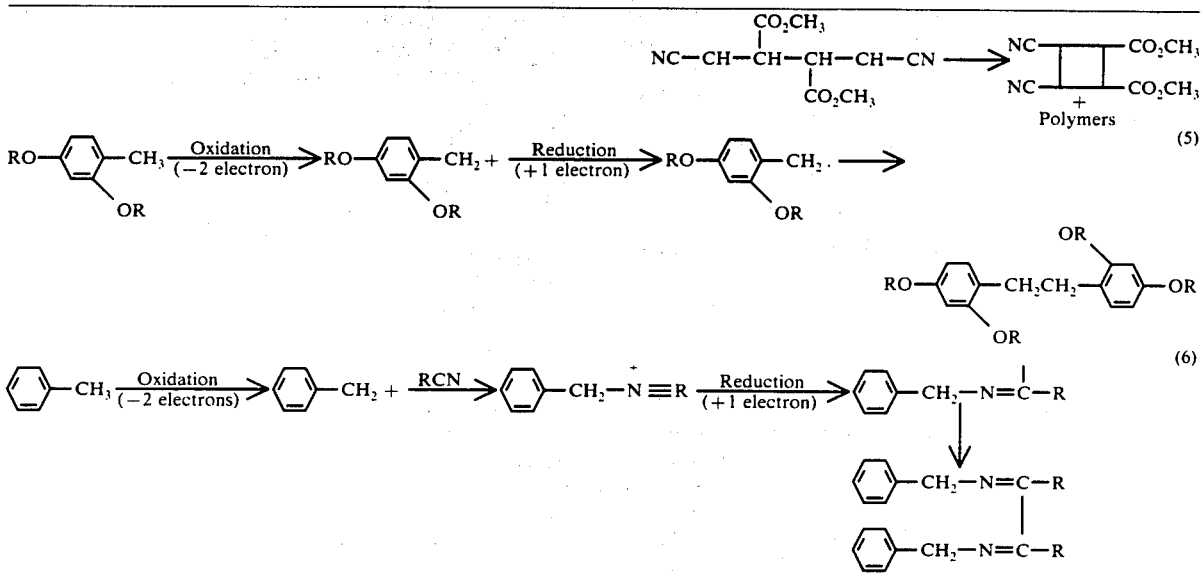

[a]R is employed herein to represent alkyl, including cycloalkyl, or aryl groups, for example, methyl, ethyl, n-propyl; i-propyl, n-butyl, i-butyl, s-butyl, t-butyl, cyclobutyl, cyclopentyl, cyclohexyl, phenyl, and the like.

Thus it is apparent that there has been provided, in accordance with the present invention, an electrolytic flow-cell apparatus and a process for effecting sequential electrochemical reactions of redoxidative compounds that fully satisfies the objects and advantages set forth hereinabove. While the invention has been described with respect to various specific examples and embodiments thereof, it will be understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. An electrolytic flow-cell apparatus suitable for effecting sequential electrochemical reactions of redoxidative compounds in a liquid electrolysis medium comprising such redoxidative compound, solvent, and supporting electrolyte, which apparatus comprises:

a. a container for holding the electrolysis medium;

b. a porous working electrode dividing the container into a first compartment and a second compartment, the electrode having a first face in the first compartment and a second and opposite face in the second compartment, at which faces the sequential reactions are conducted;

c. at least one first secondary electrode located in the first compartment and spaced from the first face of the working electrode;

d. at least one second secondary electrode located in the second compartment and spaced from the second face of the working electrode;

e. a first means for establishing a selectible electrical potential at the first face of the working electrode;

f. a second means for establishing a selectible electrical potential at the second and opposite face of the working electrode;

g. inlet means for admitting the electrolysis medium to the first compartment;

h. means for effecting flow of the electrolysis medium into the first compartment, through the working electrode, and thence into the second compartment; and i. outlet means for withdrawing the sequentially electrolyzed electrolysis medium from the second compartment.

2. The apparatus of claim 1 wherein the container is glass.

3. The apparatus of claim 1 wherein the first compartment and the second compartment are partitioned, respectively, by semipermeable dividers into a first working electrode compartment and a first secondary electrode compartment, and a second working electrode compartment and a second secondary electrode compartment.

4. The apparatus of claim 3 wherein the semipermeable dividers are fritted glass filters.

5. The apparatus of claim 1 wherein the first means for establishing a selectible electrical potential is a first controllable source of direct electrical current having at least a working electrode terminal and a secondary electrode terminal and having the working electrode and the first secondary electrode connected, respectively, to the working electrode terminal and the secondary electrode terminal via electrical lead connections.

6. The apparatus of claim 5 wherein the first controllable source further has a reference electrode terminal and a reference electrode connected thereto via an electrical lead connection.

7. The apparatus of claim 6 wherein the reference electrode is positioned substantially adjacent to the first face of the working electrode.

8. The apparatus of claim 6 wherein the first controllable source of direct electrical current is a potentiostat.

9. The apparatus of claim 1 wherein the second means for establishing a selectible electrical potential is a second controllable source of direct electrical current having at least a working electrode terminal and a secondary electrode terminal and having the working electrode and the second secondary electrode connected, respectively, to the working electrode terminal and the secondary electrode terminal via electrical lead connections.

10. The apparatus of claim 9 wherein the second controllable source further has a reference electrode terminal and a reference electrode connected thereto via an electrical lead connection.

11. The appparatus of claim 10 wherein the reference electrode is positioned substantially adjacent to the first face of the working electrode.

12. The apparatus of claim 10 wherein the second controllable source of direct electrical current is a potentiostat.

13. The apparatus of claim 1 wherein the porous working electrode is carbon.

14. The apparatus of claim 1 wherein the porous working electrode is a lead (IV) oxide anode and a lead cathode.

15. The apparatus of claim 1 wherein the first and second secondary electrodes are platinum foil.

16. The apparatus of claim 1 wherein the means for effecting flow of the electrolysis medium comprise in combination:

a. a reservoir for containing the electrolysis medium;
b. a pump for pumping the electrolysis medium;
c. a flow meter for controlling the flow rate of the electrolysis medium; and
d. means for connecting same, in the sequence set forth, to the inlet means.

* * * * *